US011136736B2

(12) United States Patent
Elmore et al.

(10) Patent No.: US 11,136,736 B2
(45) Date of Patent: Oct. 5, 2021

(54) ANCHORLESS CRASH CUSHION APPARATUS WITH METAL NOSE CAP

(71) Applicant: Lindsay Transportation Solutions, Inc., Rio Vista, CA (US)

(72) Inventors: Matthew A. Elmore, Sacramento, CA (US); Jason T. Lim, Stockton, CA (US); Alvaro E. Morales Flores, Vacaville, CA (US); Daniel Paul Dacayanan Loya, Elk Grove, CA (US); Gerrit A. Dyke, Stockton, CA (US); Jeff M. Thompson, Sacramento, CA (US)

(73) Assignee: Lindsay Transportation Solutions, Inc., Rio Vista, CA (US)

( * ) Notice: Subject to any disclaimer, the term of this patent is extended or adjusted under 35 U.S.C. 154(b) by 56 days.

(21) Appl. No.: 16/266,503

(22) Filed: Feb. 4, 2019

(65) Prior Publication Data

US 2020/0248418 A1 Aug. 6, 2020

(51) Int. Cl.
*E01F 15/00* (2006.01)
*E01F 15/08* (2006.01)

(52) U.S. Cl.
CPC ..... *E01F 15/085* (2013.01); *E01F 15/086* (2013.01); *E01F 15/088* (2013.01)

(58) Field of Classification Search
CPC ..... E01F 15/02; E01F 15/08; E01F 15/083; E01F 15/085; E01F 15/086; E01F 15/143; E01F 15/145; E01F 15/146; E01F 15/148
USPC ..... 256/13.1
See application file for complete search history.

(56) References Cited

U.S. PATENT DOCUMENTS 1,551,556 A * 9/1925 Gust ..... E01F 15/143 256/13.1
4,399,980 A * 8/1983 van Schie ..... E01F 15/146 256/13.1
5,494,371 A 2/1996 Oberth et al.
5,531,540 A * 7/1996 Wasserstrom ..... E01F 15/086 256/13.1
5,605,413 A * 2/1997 Brown ..... E01F 15/025 256/13.1
5,664,905 A * 9/1997 Thompson ..... E01D 19/103 404/6
5,988,934 A 11/1999 Wasserstrom
(Continued)

FOREIGN PATENT DOCUMENTS

WO WO-2017103890 A1 * 6/2017 ..... E01F 15/086

OTHER PUBLICATIONS

International Search Report and Written Opinion for PCT Appln. No. PCT/US2019/045200; Filed Aug. 6, 2019.

*Primary Examiner* — Thomas B Will
*Assistant Examiner* — Katherine J Chu
(74) *Attorney, Agent, or Firm* — Hovey Williams LLP

(57) ABSTRACT

An anchorless crash cushion apparatus having a plurality of interconnected water-filled crash cushion elements and a non-water filled forward-most cushion element includes vehicle capture structure resisting upward tilting of an impacting vehicle and ramping of the impacting vehicle and stabilizing structure resisting relative rotation between the crash cushion elements in both vertical and lateral planes during vehicle impact. The forward-most cushion element defines a notch and a metal nose cap having a weakened midsection is located in front of the notch.

21 Claims, 11 Drawing Sheets

(56) References Cited

U.S. PATENT DOCUMENTS 6,024,341 A * 2/2000 Gertz ..... E01F 15/146 256/1
6,059,487 A 5/2000 Naga et al.
6,082,926 A 7/2000 Zimmer
6,089,782 A * 7/2000 Bligh ..... E01F 15/143 404/6
6,179,516 B1 1/2001 Ivey et al.
6,413,009 B1 7/2002 Duckett
6,428,237 B1 * 8/2002 Duckett ..... E01F 15/086 256/13.1
6,474,904 B1 * 11/2002 Duckett ..... E01F 15/086 256/13.1
6,536,986 B1 * 3/2003 Anghileri ..... E01F 15/146 404/10
6,666,616 B2 * 12/2003 Yodock, III ..... E01F 15/083 256/13.1
6,669,402 B1 * 12/2003 Davis ..... E01F 15/086 256/13.1
6,719,483 B1 * 4/2004 Welandsson ..... E01F 15/143 404/6
6,837,647 B2 * 1/2005 Tagg ..... E01F 13/022 256/13.1
6,848,857 B1 2/2005 McColl et al.
6,913,415 B1 * 7/2005 Tagg ..... E01F 15/086 404/6
7,070,031 B2 7/2006 Smith et al.
7,144,188 B1 12/2006 Mallinson et al.
7,303,353 B2 12/2007 Carey
7,306,397 B2 * 12/2007 Albritton ..... E01F 15/0423 404/6
7,351,002 B2 4/2008 Yodock, III et al.
7,351,008 B2 4/2008 Yodock, III et al.
D596,062 S 7/2009 Yodock, III et al.
7,618,212 B2 11/2009 Yodock, III et al.
7,708,492 B2 5/2010 Carey
8,491,217 B2 7/2013 Kulp et al.
8,777,510 B2 * 7/2014 Maus ..... E01F 15/086 404/6
8,783,999 B2 7/2014 Kulp et al.
8,864,108 B2 10/2014 James
8,905,382 B2 * 12/2014 Smith ..... E01F 15/143 256/13.1
9,822,502 B2 * 11/2017 James ..... E01F 15/086
10,407,855 B2 * 9/2019 Cook ..... E01F 15/088
10,544,555 B1 * 1/2020 Lim ..... E01F 15/088
10,577,827 B2 * 3/2020 Kurtin ..... E04H 17/18
10,844,560 B2 * 11/2020 Ramaekers ..... E01F 15/08
2002/0025221 A1 2/2002 Johnson
2004/0146347 A1 * 7/2004 Davis ..... E01F 15/086 404/6
2007/0110517 A1 * 5/2007 Wasserstrom ..... E01F 15/086 404/6
2007/0243015 A1 10/2007 Yodock, III et al.
2009/0060650 A1 3/2009 Kulp et al.
2010/0111602 A1 * 5/2010 Yodock, III ..... E01F 15/088 404/6
2012/0207541 A1 * 8/2012 Maus ..... E01F 15/086 404/6
2013/0248791 A1 9/2013 Bullock
2016/0369460 A1 12/2016 Cho

* cited by examiner

ANCHORLESS CRASH CUSHION APPARATUS WITH METAL NOSE CAP

TECHNICAL FIELD

This invention relates to crash cushion apparatus employed to absorb energy from a vehicle crash. More particularly, the crash cushion apparatus of this invention is a water based crash cushion system non-anchored along the length thereof attached at its rear end to a rigid hazard object.

BACKGROUND OF THE INVENTION

Water based non-anchored crash cushions are known in the art and they operate primarily by momentum transfer (the impact of the impacting vehicle is transferred to the expelled water when the modules fracture and the water is dispersed at high velocity).

In these prior art arrangements a portion of the energy of the impacting vehicle is transferred through compressive forces applied from collapsing the structural elements and a small amount from pressure building up in the water containers. Utilizing the principles of the present invention, as compared to the known prior art, the compression is significant during the later phase of the impact where the rate of compression is less, a much larger portion of the energy being absorbed by the compressive forces prior to the plastic containers fracturing during the mid to late period of the impact event. This is accomplished by using plastic formulations that are less frangible and thus hold together longer to allow the pressure to build up more during the compression phase than the other cushions in this category.

The following documents are believed to be representative of the state of the prior art in this field: U.S. Pat. No. 7,351,002, issued Apr. 1, 2008, U.S. Pat. No. 6,666,616, issued Dec. 23, 2003, U.S. Pat. No. 8,864,108, issued Oct. 21, 2014, U.S. Pat. No. 8,783,999, issued Jul. 22, 2014, U.S. Pat. No. 7,708,492, issued May 4, 2010, U.S. Pat. No. 7,144,188, issued Dec. 5, 2006, U.S. Pat. No. 7,070,031, issued Jul. 4, 2006, U.S. Pat. No. 6,913,415, issued Jul. 5, 2005, U.S. Pat. No. 6,413,009, issued Jul. 2, 2002, U.S. Pat. No. 5,988,934, issued Nov. 23, 1999, U.S. Pat. No. 5,531,540, issued Jul. 2, 1996, U.S. Pat. No. 6,179,516, issued Jan. 30, 2001, U.S. Pat. No. 6,669,402, issued Dec. 30, 2003, U.S. Pat. No. 7,618,212, issued Nov. 17, 2009, U.S. Pat. No. 6,082,926, issued Jul. 4, 2000, U.S. Pat. No. 6,848,857, issued Feb. 1, 2005, U.S. Pat. No. 7,303,353, issued Dec. 4, 2007, U.S. Patent App. Pub. No. US 2010/0111602, published May 6, 2010, U.S. Patent App. Pub. No. US 2007/0243015, published Oct. 18, 2007, U.S. Pat. No. 8,491,217, issued Jul. 23, 2013, U.S. Pat. No. 8,777,510, issued Jul. 15, 2014, U.S. Pat. No. 9,822,502, issued Nov. 21, 2017, U.S. Pat. No. 7,351,008, issued Apr. 1, 2008, U.S. Pat. No. 6,474,904, issued Nov. 5, 2002, U.S. Patent App. Pub. No. US 2002/0025221, published Feb. 28, 2002, U.S. Design Pat. No. D596,062, issued Jul. 14, 2009, U.S. Patent App. Pub. No. US 2009/0060650, published Mar. 5, 2009 and U.S. Pat. No. 6,059,487, issued May 9, 2000.

BRIEF SUMMARY OF THE INVENTION

The anchorless crash cushion apparatus of the present invention includes a plurality of interconnected water-filled crash cushion elements and a forward element.

Vehicle capture structure is operatively associated with the forward element and operable to capture a vehicle frontally impacting the forward element, resist upward tilting of the impacting vehicle and substantially prevent ramping of the impacting vehicle over the forward element and following elements.

The anchorless crash cushion apparatus may include a plurality of stabilizing structures. Some embodiments of the stabilizing structure include a midnose structure operatively associated with the plurality of interconnected crash cushion elements to resist relative rotation therebetween in both vertical and lateral planes during vehicle impact.

A metal nose cap is located in front of the forward element and is cooperable with the forward element to capture a frontal impacting vehicle and reduce downward pitch of smaller vehicles with lower centers of gravity and also assist with capture of the vehicle bumper.

Other features, advantages and objects of the present invention will become apparent with reference to the following description and accompanying drawings.

BEST MODE FOR CARRYING OUT THE INVENTION

Figure 1:
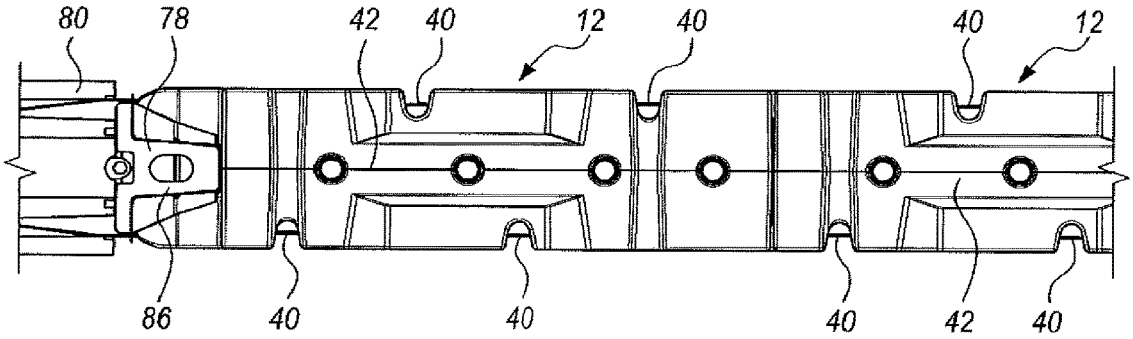
FIG. 1 is a top, plan view showing a portion of the anchorless crash cushion apparatus of the present invention attached to the end of a rigid hazard object by a transition weldment of the invention.
Figure 2:
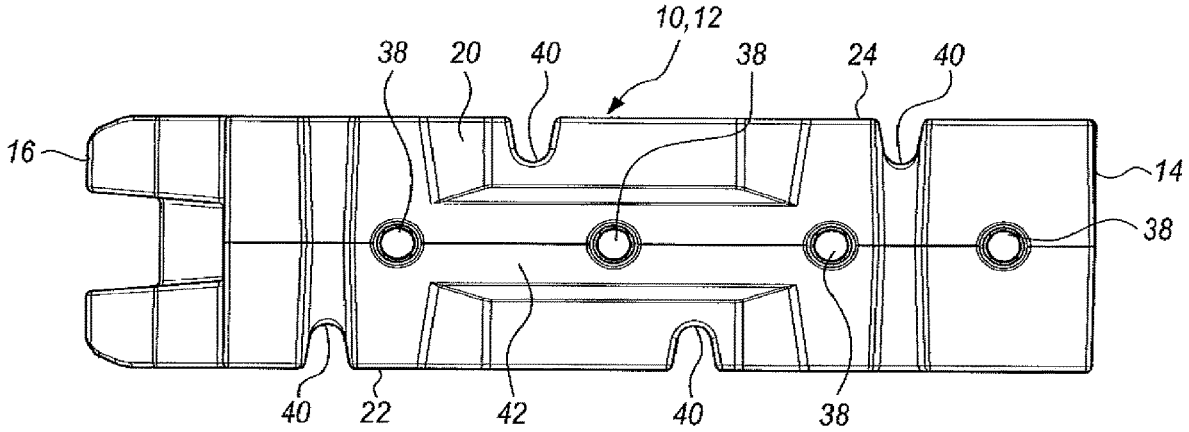
FIG. 2 is an enlarged, plan view showing a plastic crash cushion element constructed in accordance with the teachings of the present invention.
Figure 3:
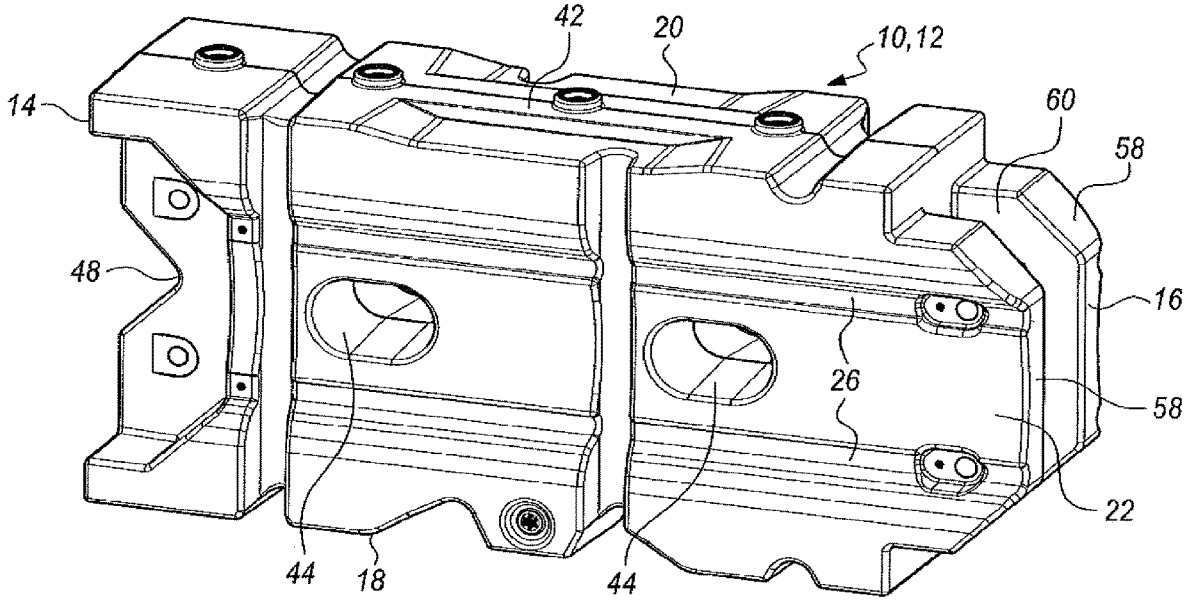
FIG. 3 is an enlarged, frontal perspective view of the plastic crash cushion element.
Figure 4:
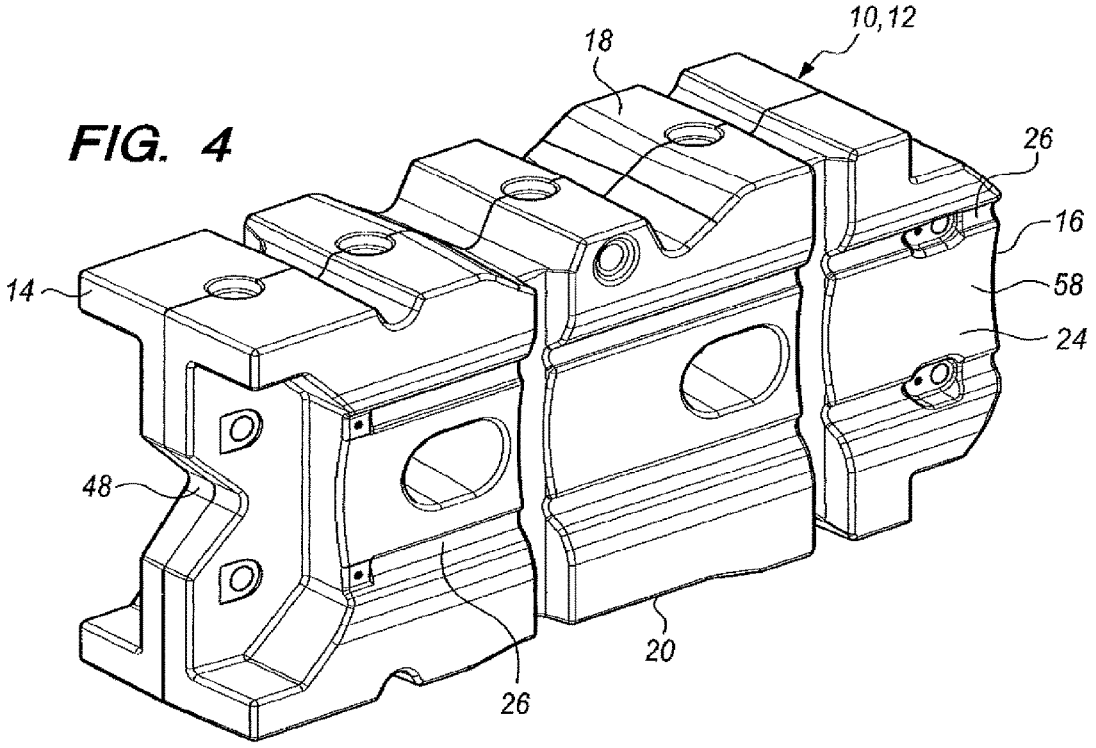
FIG. 4 is a rear, perspective view of the plastic crash cushion element.
Figure 5:
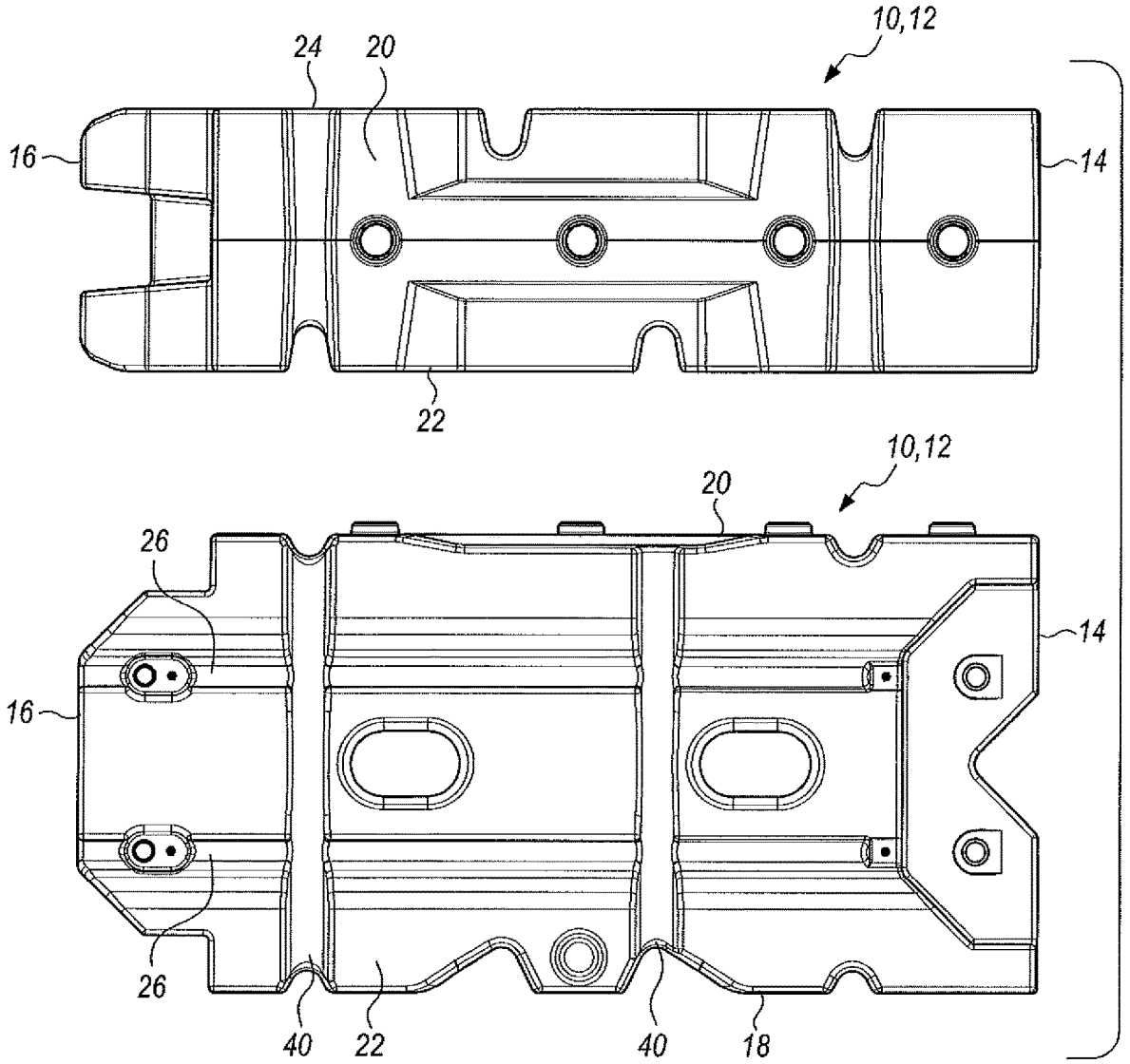
FIG. 5 shows a side elevational view of the plastic crash cushion element along with the plan view depicted in FIG. 2.
Figure 6:
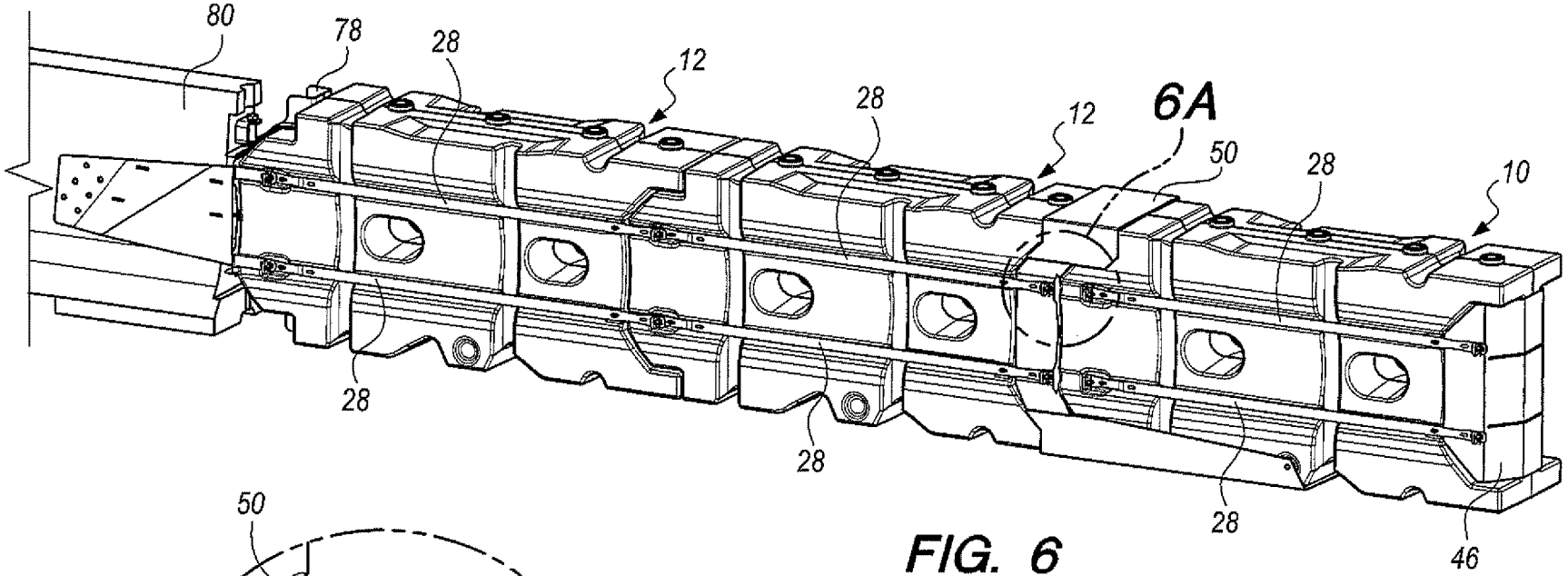
FIG. 6 is a perspective view of the fully assembled, interconnected crash cushion elements of the anchorless crash cushion apparatus attached to the end of the rigid hazard object.
Figure 6A:
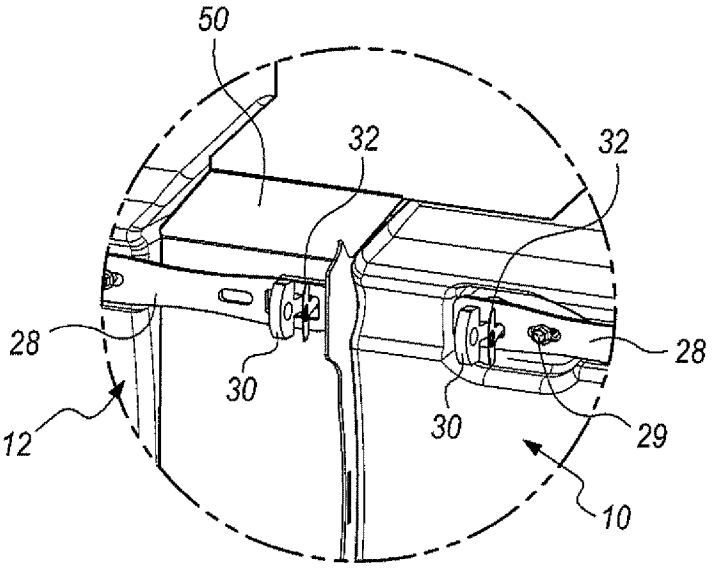
FIG. 6A is an enlarged detail perspective view of the view portion 6A indicated in FIG. 6.
Figure 7:
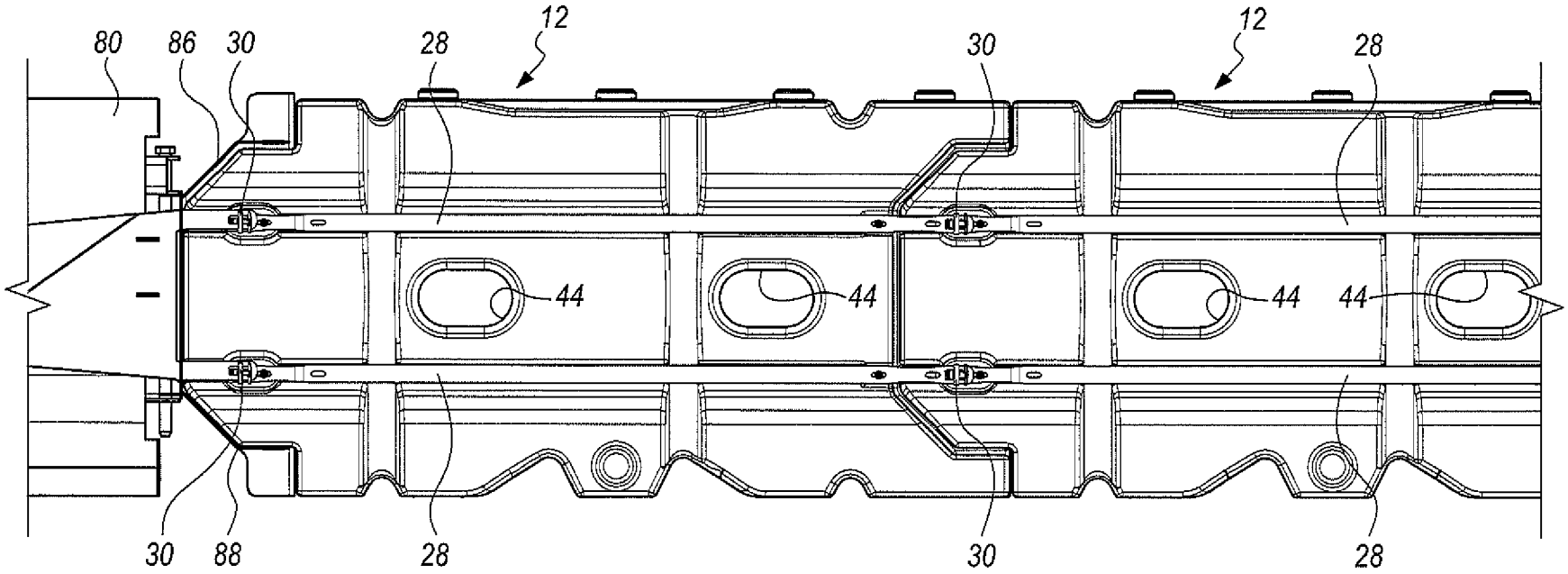
FIG. 7 is an enlarged, side elevational view showing a rear portion of the fully assembled anchorless crash cushion apparatus attached to the rigid hazard object.

Referring now to the drawings, anchorless crash cushion apparatus constructed in accordance with the present invention includes a plurality of plastic crash cushion elements or modules of identical construction, including an empty forward element 10 and water-filled elements 12, one of the water-filled elements 12 located adjacent to and immediately behind forward element 10.

Each of the crash cushion elements or modules is hollow and has an element front 14, an element back 16, an element bottom 18, an element top 20 and element sides 22, 24.

The element sides 22, 24 of the plurality of interconnected crash cushion elements each form a pair of elongated cavities 26 spaced from one another and extending along the sides, the elongated cavities 26 of the elements being in substantial alignment.

Other embodiments of the stabilizing structure include straps 28 of steel or other suitable metal extending along the elongated cavities 26 are attached to the crash cushion elements.

Connector pins 30 extend between and through the element sides of the plurality of crash cushion elements and through overlapping ends of the metal straps extending from the elongated cavities of adjacent crash cushion elements.

The connector pins 30 are operable to pass through and connect together the metal straps 28 on both sides 22, 24 of the adjacent crash cushion elements. The connector pins 30 include spring clips 32 to selectively latch the connector pins to or unlatch the connector pins from the crash cushion elements.

Upper and lower metal straps are mounted at each element side and maintained under tension by the connector pins passing through the bodies of the connected elements. The elongated cavities 26 operate as tension strap valleys constraining the metal straps vertically and maintaining spacing between the tensioned upper and lower metal straps.

Spaced vertical buckling cavities 40 are formed in the element sides 22, 24, the buckling cavities at opposed element sides being alternately positioned and offset from one another. Initial impact by a vehicle compresses alternating buckling cavities at opposite element sides and operates to create a zig-zag compression and stabilize a column formed by the interconnected crash cushion elements. A zig-zag pattern is disclosed generally in U.S. Pat. No. 6,428,237, issued Aug. 6, 2002, but is substantially less in the apparatus of the present invention.

A top stiffness spine 42 is formed at the element top spaced from and positioned between the locations of the buckling cavities 40. Fill holes with plastic plugs 38 act as water filling ports and relieve excess water pressure during impact. The fill holes are raised and prevent liquid (usually rain water) that pools at the top surface of the element from draining into the element during storage. Reciprocal structures on the underside of the elements restrict horizontal movement when stacked.

Port defining passageway structures 44 extend between the element sides, the ports at the sides allowing fork lifts (not shown) to transport elements. Rigidity of the element is increased by rigidly connecting the otherwise unsupported long vertical element sides. Rounded corners eliminate stress concentrations during impact and provide more uniform thickness during rotomolding process.

The metal straps 28 are substantially unattached to the element sides 22, 24 between the connector pins 30. The straps buckle and bend outwardly away from the element sides when a compressive force collapses a crash cushion element to which the strap is attached by a connector pin. Bolts 29 may be employed to keep the straps from falling from the crash cushion element if connector pins are removed for maintenance or other purposes.

Figure 8:
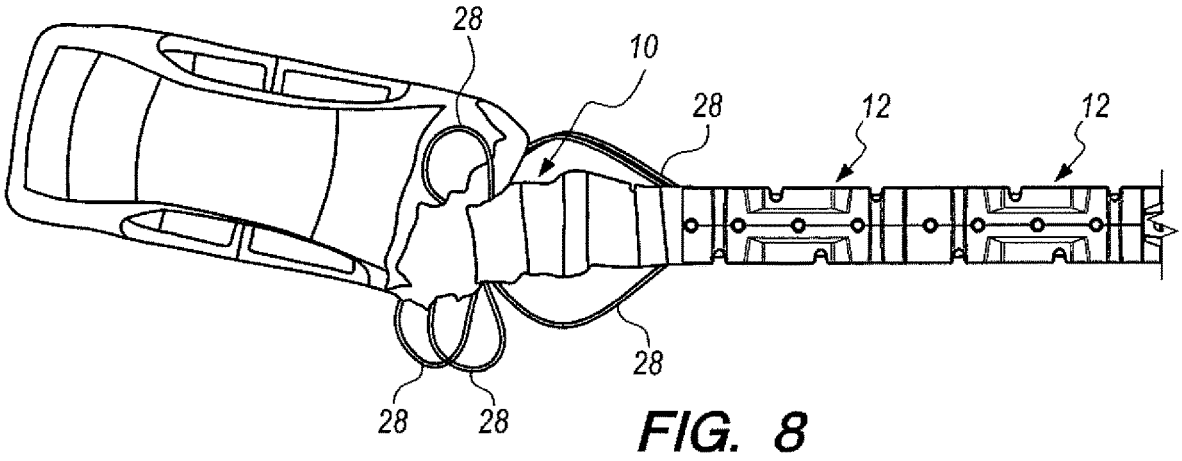
FIG. 8 is a top plan view illustrating the condition of the anchorless crash cushion apparatus when impacted head on by a vehicle.
Figure 9:
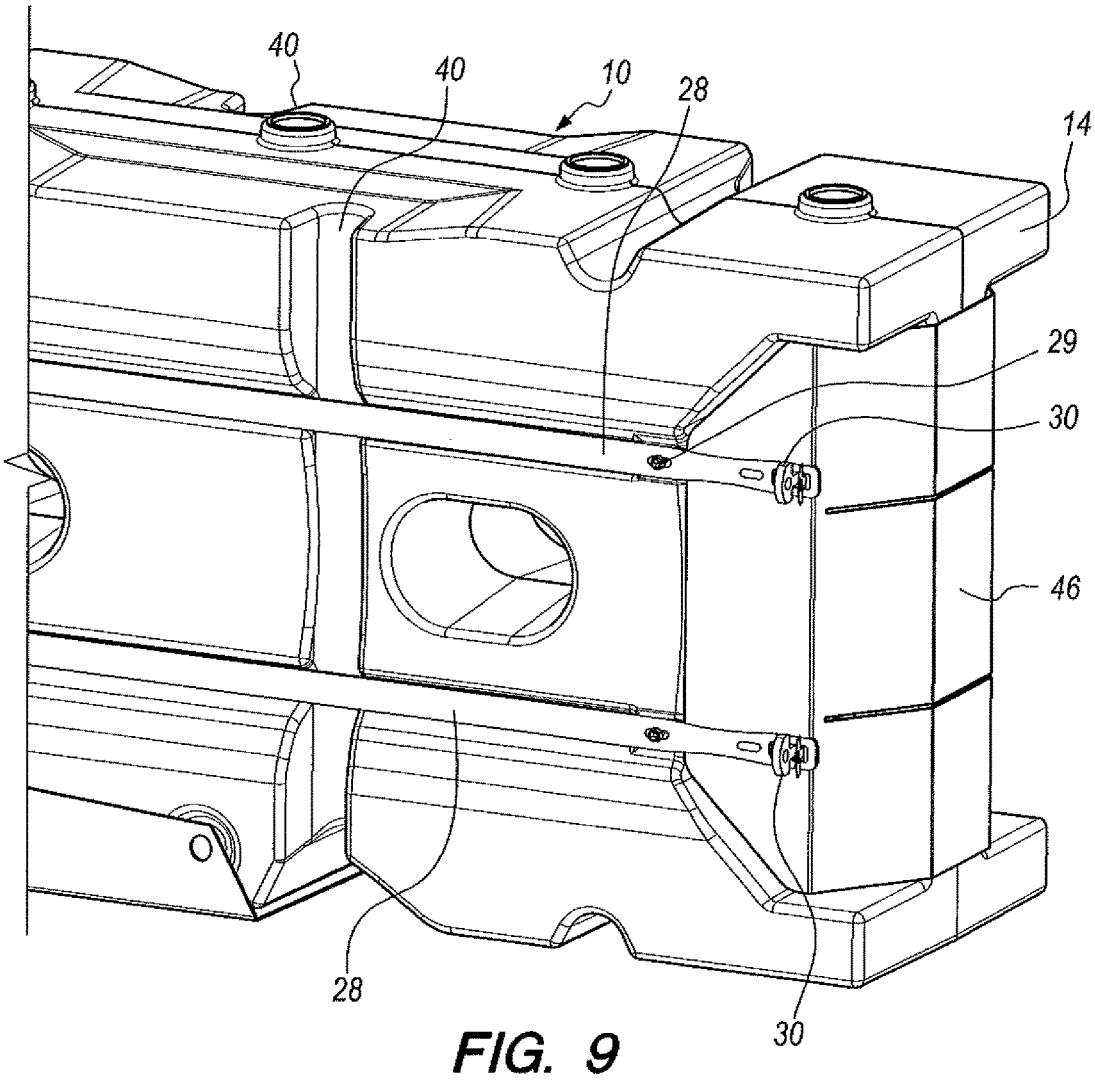
FIG. 9 is a perspective view illustrating the forward element of the apparatus including a metal nose cap located at the front thereof and metal tension straps along a forward element side extending and connected to the metal nose cap.
Figure 10:
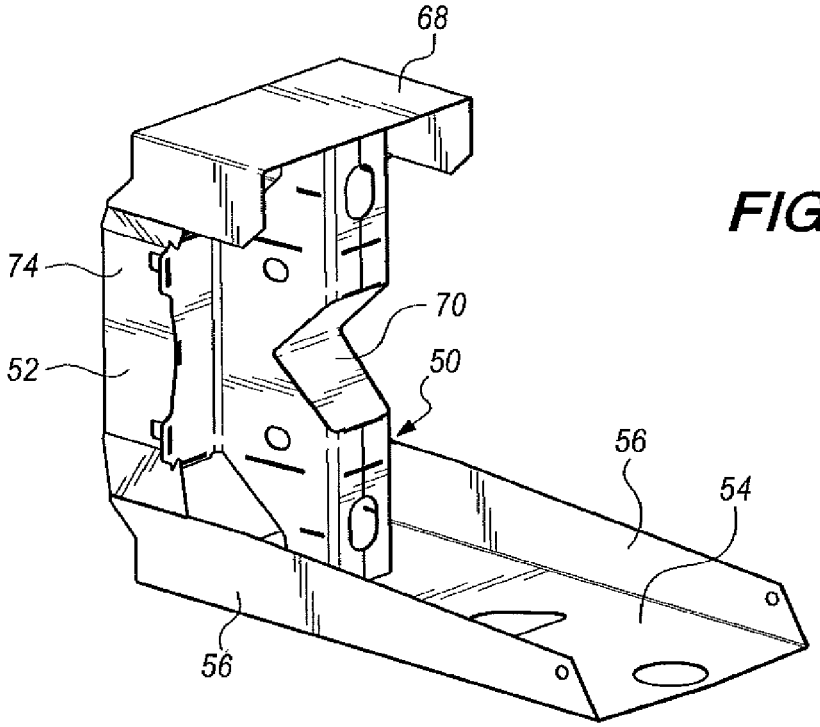
FIG. 10 is an enlarged frontal, perspective view of midnose structure of the apparatus.
Figure 11:
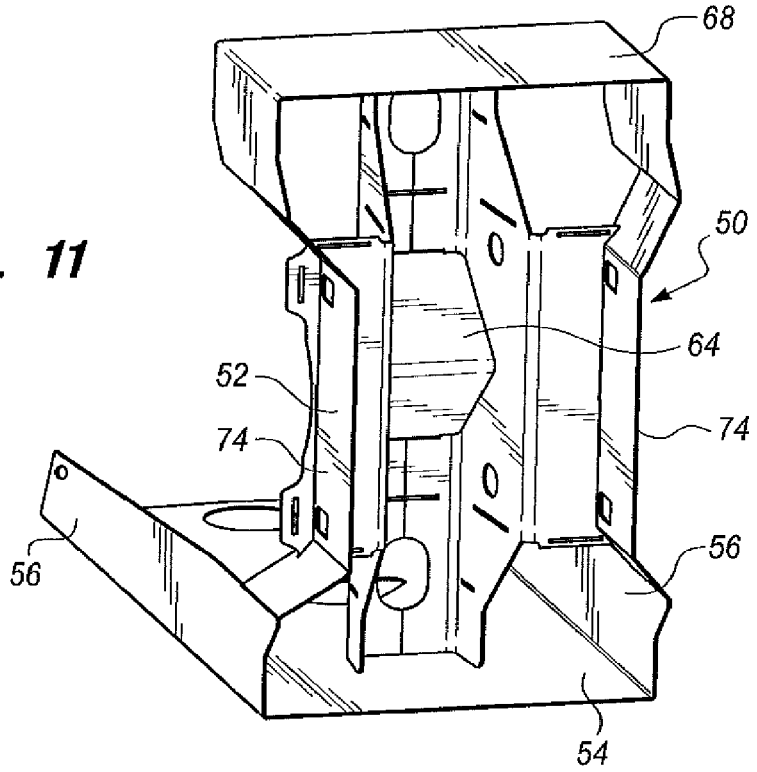
FIG. 11 is a rear, perspective view of the midnose structure.
Figure 12:
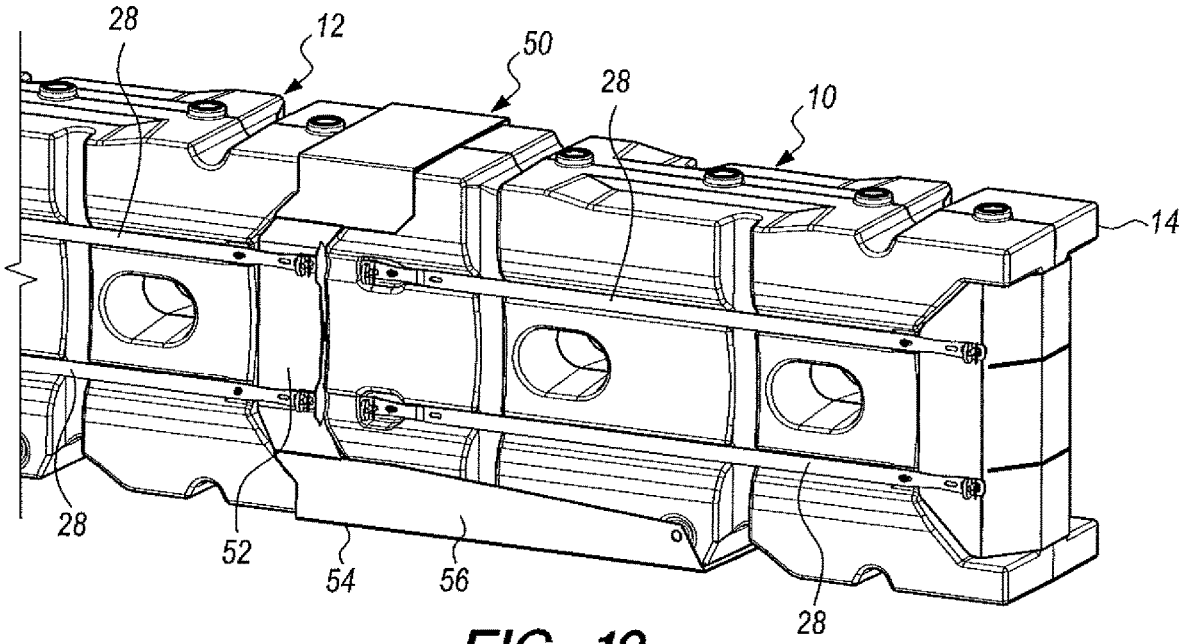
FIG. 12 is a perspective view showing the midnose structure located between the forward element and the element immediately behind the forward element.
Figure 13:
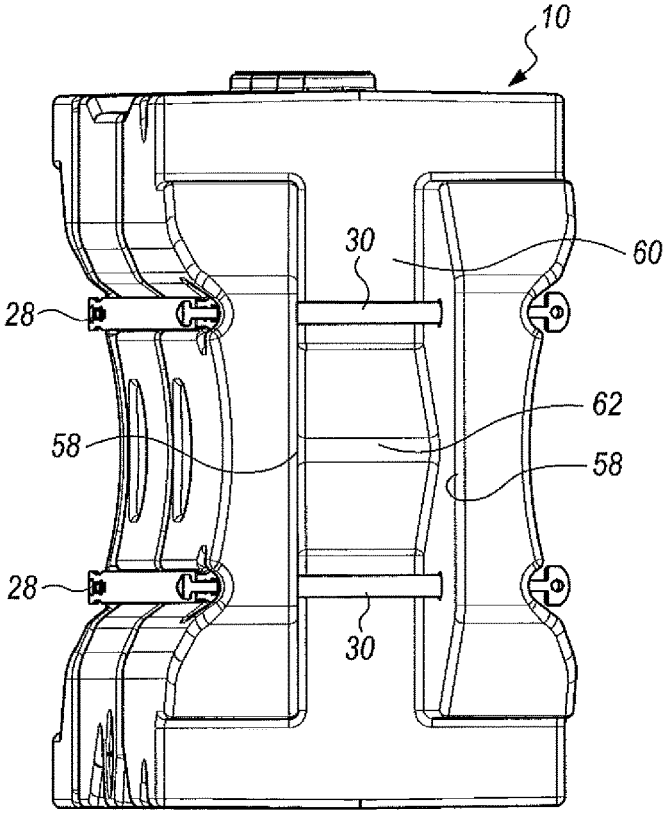
FIG. 13 is an enlarged, perspective view of the forward element illustrating metal straps and connector pins connected thereto.
Figure 14:
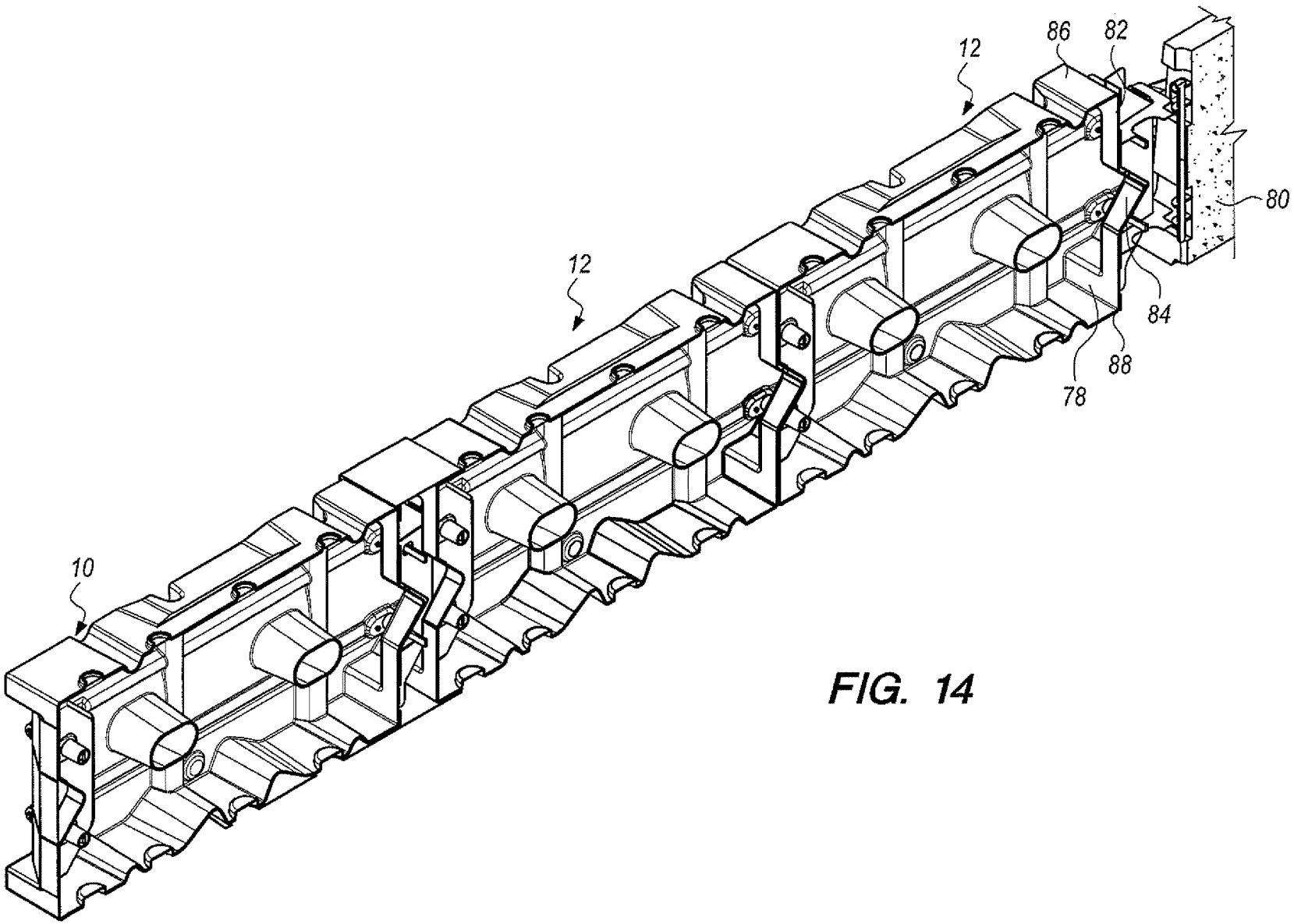
FIG. 14 is a perspective view illustrating in longitudinal cross-section a rear portion the anchorless crash cushion apparatus attached to the rigid hazard object.
Figure 15:
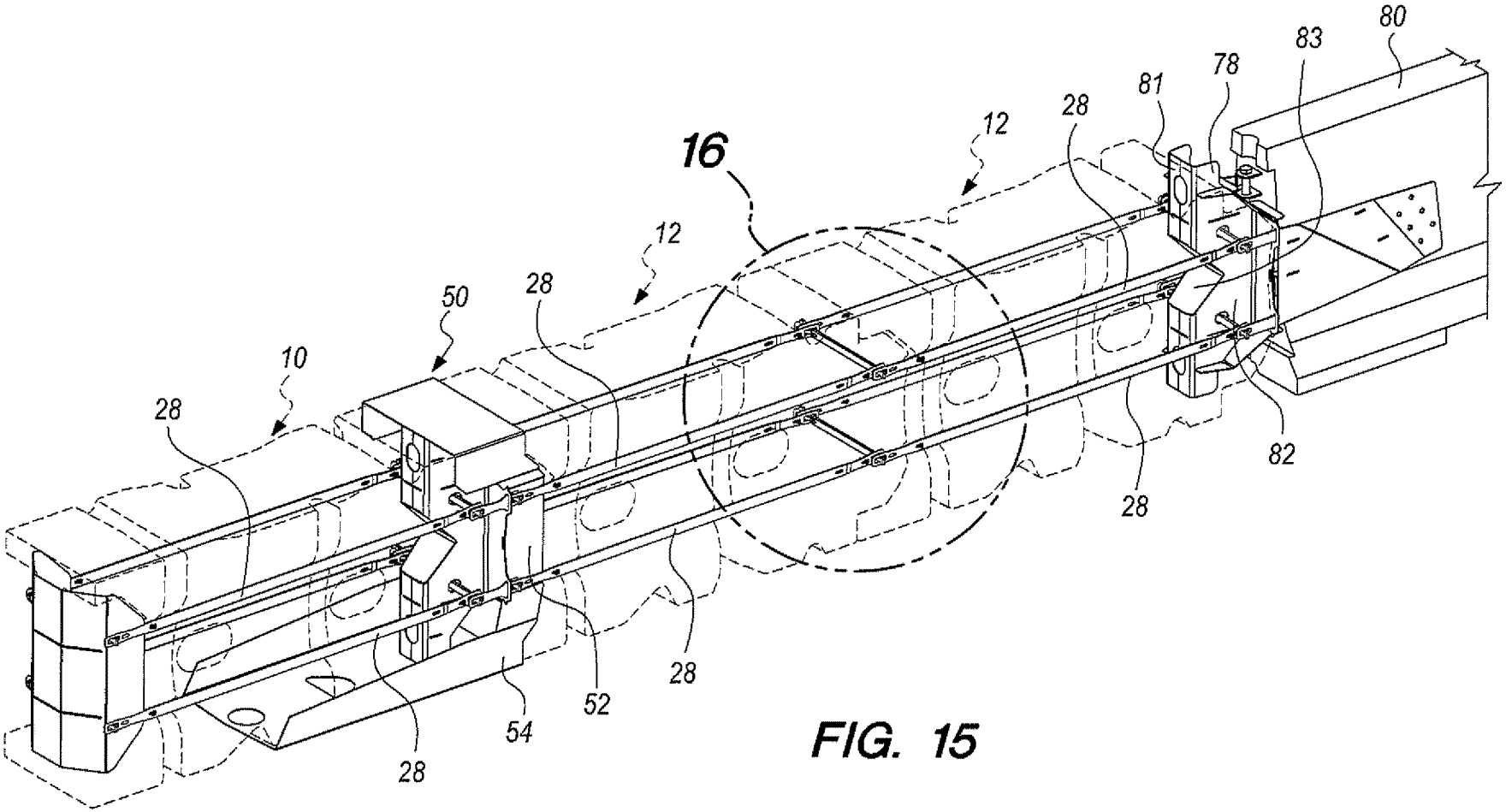
FIG. 15 is a perspective view of the anchorless crash cushion apparatus attached to the rigid hazard object with the elements shown in dash lines and other structural components of the invention in solid lines.
Figure 16:
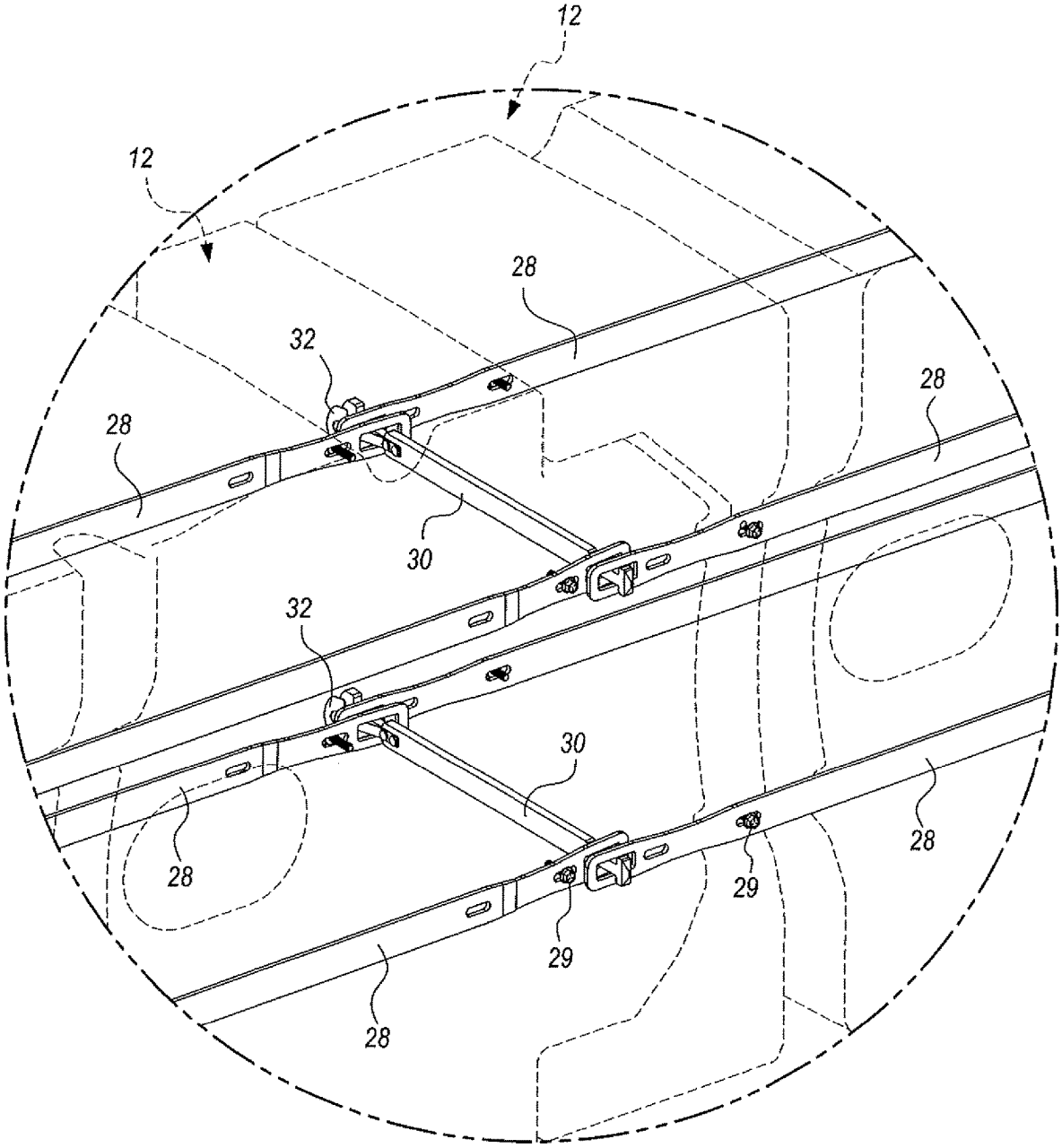
FIG. 16 is a greatly enlarged, perspective view illustrating details of structural features located in the view area 16 depicted in FIG. 15.

FIG. 8 illustrates the straps bending outwardly when a vehicle has impacted the forward element 10 and also is crushing other elements of the apparatus. The structural straps along both sides of the elements and the connections between the two sides through the molded elements help stabilize the overall system during an impact crash. This structure also aids in keeping modules together in the post impact configuration to reduce the amount of debris and the area that the debris covers. This reduces the potential hazard presented to adjacent motorists. This structure also aids in improved side angle impact performance by connecting the mass of all the elements together to resist lateral movement. This reduces the potential of the impacting vehicle penetrating excessively and contacting the rigid hazard object at the rear of the system.

A metal nose cap 46 is located at the front 14 of the forward element 10. Metal tension straps along the forward element extend to the metal nose cap and are connected thereto. The front 14 defines a notch 48 behind the metal nose cap 46. The metal nose cap has a midsection located in front of the notch. The metal nose cap and the forward element are cooperable to capture a frontal impacting vehicle and reduce downward pitch of smaller vehicles with low centers of gravity and also assist in the capture of the vehicle bumper.

The nose cap has a surface with visible delineation and provides extra reinforcement of the tension straps to the front of the forward element.

A metal midnose structure 50 engages the element back of the forward element 10 and the element front of the adjacent crash cushion element 12. The midnose structure is operable to contain and control debris from the forward element when collapsed by an impacting vehicle, operable upon subsequent engagement thereof by the vehicle to even the distributed compressive forces of the vehicle to downstream crash cushion elements, and operable to deter against backward tipping of the forward element.

The metal midnose structure is L-shaped and includes a vertical midnose member 52 extending upwardly from a horizontal midnose member 54.

The vertical midnose member 52 is positioned behind the forward element 10 and in front of the adjacent crash cushion element 12. The horizontal midnose member 54 is positioned under at least a portion of the forward element 10. Side panels 56 extend upwardly from the horizontal midnose 54 and are disposed over lower side portions of forward element 10.

The metal midnose structure 50 as well as the metal straps 28 help stabilize the tendency of the water-filled modules to skew (buckle) in the horizontal plane as well as the vertical plane. This significantly helps keeping the system from buckling during the compressive phase when the pressure is higher. With increasing pressure there is a natural tendency for the elements to zig-zag which relieves the longitudinal loading into the vehicle. By limiting zig-zag formation and keeping the elements in better alignment higher pressures are allowed to build up and keep the higher loading pointed along the longitudinal axis of the impacting vehicle, resulting in more efficient absorption of the vehicle impact energy, bringing the vehicle to a controlled stop in a shorter distance with acceptable occupant risk factors (g-levels, roll/pitch/yaw, etc).

The metal midnose structure 50 aids in reducing the vaulting tendency of the vehicle impacting the filled elements of the cushion. This is accomplished by increasing the resistance to a vertical rotation of the connection between the forward element and the adjacent element and reduces the overall upward pitching tendency. Without this structure the effect would result in the vehicle energy not being absorbed efficiently because as the vehicle vaults, the longitudinal force on the vehicle that slows it is redirected upward and outside of the center of pressure. Thus, the longitudinal force into the vehicle drops off quickly, the vehicle velocity is not significantly further reduced, and is not brought to a controlled stop by the cushion.

The forward element back 16 includes spaced rear connector projections 58 defining a connector recess 60 and a stabilizing member 62 between the connector projections. The vertical midnose member 52 includes a midnose connector protrusion 64 defining a notch receiving the stabilizing member 62.

The midnose structure 50 includes an upper panel 68 located above the midnose connector protrusion 64, the upper panel is positioned over a portion of the forward element 10.

The midnose connector protrusion 64 defines a midnose connector recess 70 for receiving a connector protrusion extending from the adjacent crash cushion element 12.

The midnose structure 50 additionally includes side panels 74 extending upwardly from the horizontal midnose member 54 alongside lower portions of the forward element sides 22, 24.

The anchorless crash cushion apparatus of this invention incorporates an interlocking geometry feature resisting location of the vertical and lateral planes at the connection between elements. Interconnection structure is similar to the essentially tab like arrangement employed at the forward element and adjacent element with the connection with the midnose structure. Each of the elements has two tabs or projections extending outward at the sides from one end of the forward element 10 and also connector recess structure at the opposite end thereof corresponding to the connector structure cooperating therewith utilized in the metal midnose structure. These arrangements are essentially tabs which protrude from the ends of the elements 12 and mate with central tab structure of the adjoining element. Connector pins extending through holes across the elements lock the two elements to one another and such horizontal pin connection increases moment capacity to resist lateral rotation, essentially functioning as mating interlocking tabs.

A transition weldment 78 is incorporated in the anchorless crash cushion apparatus of this invention for attaching the apparatus to a rigid hazard object such as that indicated by reference numeral 80. The transition weldment provides additional crush for heavy vehicles that bottom out and increase collapse from impact of heavier vehicles with excessive impact velocity to provide a higher margin of safety for vehicle occupants.

The transition weldment includes a weldment housing 82 having side walls and a welded notched front plate 81 only welded at the top and bottom, allowing the side walls of the weldment housing to collapse when impacted from the front along the centerline of the apparatus.

Metal straps 28 are attached to the transition weldment and to an endmost crash cushion element 12 and connector pins 30 extend through the metal straps connecting the transition weldment and the endmost crash cushion element. The notch 83 of the front plate conforms to the shape of and receives the element back. The transition weldment includes upper and lower brackets 86, 88 securing the weldment housing to the rigid hazard object, the weldment housing otherwise not being welded to the rigid hazard object.

The weldment is rigid enough to not begin to crush as the system is compressing until the vehicle starts to interact with the end of the system. This latent crush adds some residual capacity to the system in the final milliseconds of the impact. The notch still provides some rigidity in angled impacts so as to reduce the pocketing into the system just before the rigid hazard object.

The forward element 10 will still fracture in the early stages of the impact due to the high rate of loading and the disposition of the mass of water will reduce the velocity of the impacting vehicle by the momentum transfer/impulse mechanism. However, as the velocity of the impacting vehicle is decreased, the rate of transfer is reduced to a point that momentum transfer becomes inefficient. Thus, with the improved compression characteristics in the later stages of the impact, the final energy absorption is accomplished by increased compression force during the displacement period prior to the last element finally fracturing and dispersing the water. This final water dispersion is at a very low velocity and inefficient (much of the water "leaks" out instead of being sprayed out).

As indicated above, the forward element is substantially empty (not filled with water). At high velocity, the rate of momentum transfer would cause excessive g levels for lighter weight vehicles. The stabilizing structures including the metal straps provide sufficient force to slow smaller vehicles so that the rate of momentum transfer as the rear view (water filled) elements are encountered acceptable g levels can be achieved and the total length of the crash cushion apparatus is optimized between the light and heavy vehicle.

The invention claimed is:

1. An anchorless crash cushion apparatus comprising:

a plurality of crash cushion elements filled with water and configured to connect to one another;

an empty forward element positioned in front of the crash cushion elements and including a rearward extending notch located at a front end roughly midway between a top and a bottom thereof, wherein the forward element and each crash cushion element include:

a top wall and a spaced apart bottom wall, a left side wall and a spaced apart right side wall, each side wall coupled to the top wall and the bottom wall, each side wall including a side wall projection extending rearward at a rear edge and a side wall recess extending inward at a front edge, and a rear wall and a spaced apart front wall, each of the rear wall and the front wall coupled to the top wall, the bottom wall, the left side wall, and the right side wall, the rear wall further including a stabilizing member extending therefrom and the front wall includes a notch complementary to the stabilizing member such that the stabilizing member of one crash cushion element is configured to fit into the notch of another crash cushion element when one crash cushion element is connected to another crash cushion element;

a nose cap configured to connect to the front end of the forward element, the nose cap including a first slit horizontally oriented and positioned at a first height, and a second slit horizontally oriented and positioned at a second height, the first slit and the second slit in combination forming a weakened midsection positioned in alignment with the notch of the forward element; and a vehicle capture structure formed by the nose cap and the forward element, the vehicle capture structure configured to capture a vehicle frontally impacting the forward element, resist upward tilting of the impacting vehicle, and substantially prevent ramping of the impacting vehicle over the forward element.

2. The anchorless crash cushion apparatus of claim 1, wherein the top wall includes a stiffness spine oriented axially, the stiffness spine including a section of the top wall that is raised above transversely adjacent sections.

3. The anchorless crash cushion apparatus of claim 1, wherein the bottom wall includes a plurality of indentations oriented transversely.

4. The anchorless crash cushion apparatus of claim 1, wherein each side wall includes a plurality of buckling cavities oriented vertically.

5. The anchorless crash cushion apparatus of claim 1, wherein the side wall recesses are complementary to the side wall projections such that each side wall projection of one crash cushion element is configured to fit into one of the side wall recesses of another crash cushion element when one crash cushion element is connected to another crash cushion element.

6. The anchorless crash cushion apparatus of claim 1, further comprising a plurality of connector pins, with two connector pins configured to extend through the side wall projections of one crash cushion element and a portion of the front wall of another crash cushion element when one crash cushion element is connected to another crash cushion element.

7. The anchorless crash cushion apparatus of claim 6, wherein a first of the two connector pins is configured to be positioned spaced apart from and above a second of the two connector pins.

8. The anchorless crash cushion apparatus of claim 6, further comprising a plurality of straps, each strap configured to connect a first connector pin to a second connector pin.

9. The anchorless crash cushion apparatus of claim 1, further comprising a plurality of straps, each strap configured to couple a first joint of a first pair of connected crash cushion elements to a second joint of a second pair of connected crash cushion elements.

10. The anchorless crash cushion apparatus of claim 9, wherein each strap is further configured to be positioned in one of two cavities that extend axially along each of the left side wall and the right side wall.

11. The anchorless crash cushion apparatus of claim 1, further comprising a midnose structure configured to be positioned between the forward element and the first crash cushion element and to reduce the vaulting tendency of the vehicle impacting the crash cushion elements, the midnose structure including:

a front section configured to couple to the rear wall of the forward element, the front section including a couple of midnose recesses, each midnose recess configured to receive the side wall projection from either the left side wall or the right side wall of the forward element, and a rear section configured to couple to the front wall of the first crash cushion element, the rear section including a couple of midnose projections, each midnose projection configured to fit into the side wall recess of either the left side wall or the right side wall of the first crash cushion element.

12. The anchorless crash cushion apparatus of claim 11, wherein the midnose structure further includes:

a lower horizontal member configured to contact the bottom wall of the forward element and to underlie a portion thereof and an upper horizontal member configured to contact the top wall of the forward element and overlap a portion thereof.

13. The anchorless crash cushion apparatus of claim 1, further comprising a transition weldment positioned between a last crash cushion element and a rigid structure, the transition weldment including a housing with side walls, a front plate configured to receive the rear wall of the last crash cushion element, and an upper bracket and a lower bracket each configured to secure the housing to the rigid structure.

14. An anchorless crash cushion apparatus comprising:

a plurality of crash cushion elements filled with water and configured to connect to one another;

an empty forward element positioned in front of the crash cushion elements, the forward element and each crash cushion element including a top wall and a spaced apart bottom wall, a left side wall and a spaced apart right side wall, each side wall coupled to the top wall and the bottom wall, each side wall including a side wall projection extending rearward at a rear edge and a side wall recess extending inward at a front edge, a rear wall and a spaced apart front wall, each of the rear wall and the front wall coupled to the top wall, the bottom wall, the left side wall, and the right side wall, the front wall including a rearward extending notch located roughly midway between the top wall and the bottom wall and the rear wall including a forward extending stabilizing member located roughly midway between the top wall and the bottom wall;

a nose cap configured to connect to the front end of the forward element, the nose cap including a first slit horizontally oriented and positioned at a first height, and a second slit horizontally oriented and positioned at a second height, the first slit and the second slit in combination forming a weakened midsection positioned in alignment with the notch of the forward element;

a vehicle capture structure formed by the nose cap and the forward element, the vehicle capture structure configured to capture a vehicle frontally impacting the forward element, resist upward tilting of the impacting vehicle and substantially prevent ramping of the impacting vehicle over the forward element;

a plurality of straps, each strap configured to couple a first joint of a first pair of connected crash cushion elements to a second joint of a second pair of connected crash cushion elements; and a midnose structure configured to be positioned between the forward element and a first crash cushion element and to reduce the vaulting tendency of the vehicle impacting the crash cushion elements, the midnose structure including:

a front section configured to couple to the rear wall of the forward element, the front section including a couple of midnose recesses, each midnose recess configured to receive the side wall projection from either the left side wall or the right side wall of the forward element, and a rear section configured to couple to the front wall of the first crash cushion element, the rear section including a couple of midnose projections, each midnose projection configured to fit into the side wall recess of either the left side wall or the right side wall of the first crash cushion element.

15. The anchorless crash cushion apparatus of claim 14, wherein the midnose structure further includes:

a lower horizontal member configured to contact the bottom wall of the forward element and to underlie a portion thereof and an upper horizontal member configured to contact the top wall of the forward element and overlap a portion thereof.

16. The anchorless crash cushion apparatus of claim 14, further comprising a transition weldment positioned between a last crash cushion element and a rigid structure, the transition weldment including a housing with side walls, a front plate configured to receive the rear wall of the last crash cushion element, and an upper bracket and a lower bracket each configured to secure the housing to the rigid structure.

17. An anchorless crash cushion apparatus comprising:

a plurality of crash cushion elements filled with water and configured to connect to one another;

an empty forward element positioned in front of the crash cushion elements, the forward element and each crash cushion element including a top wall and a spaced apart bottom wall, a left side wall and a spaced apart right side wall, each side wall coupled to the top wall and the bottom wall, each side wall including a side wall projection extending rearward at a rear edge and a side wall recess extending inward at a front edge, a rear wall and a spaced apart front wall, each of the rear wall and the front wall coupled to the top wall, the bottom wall, the left side wall, and the right side wall;

a nose cap configured to connect to the front end of the forward element, the nose cap including a first slit horizontally oriented and positioned at a first height, and a second slit horizontally oriented and positioned at a second height, the first slit and the second slit in combination forming a weakened midsection positioned in alignment with the notch of the forward element;

a midnose structure configured to be positioned between the forward element and the first crash cushion element and to reduce the vaulting tendency of the vehicle impacting the crash cushion elements, the midnose structure including a front section configured to couple to the rear wall of the forward element, the front section including a couple of midnose recesses, each midnose recess configured to receive the side wall projection from either the left side wall or the right side wall of the forward element, and a rear section configured to couple to the front wall of the first crash cushion element, the rear section including a couple of midnose projections, each midnose projection configured to fit into the side wall recess of either the left side wall or the right side wall of the first crash cushion element;

a transition weldment positioned between a last crash cushion element and a rigid structure, the transition weldment including a housing with side walls, a front plate configured to receive the rear wall of the last crash cushion element, and an upper bracket and a lower bracket each configured to secure the housing to the rigid structure; and a plurality of straps, each strap configured to couple a first joint of a first pair of connected crash cushion elements to a second joint of a second pair of connected crash cushion elements.

18. An anchorless crash cushion apparatus comprising:

a plurality of crash cushion elements filled with water and configured to connect to one another;

an empty forward element positioned in front of the crash cushion elements and including a rearward extending notch located at a front end roughly midway between a top and a bottom thereof, wherein the forward element and each crash cushion element include:

a top wall and a spaced apart bottom wall, a left side wall and a spaced apart right side wall, each side wall coupled to the top wall and the bottom wall, each side wall including a side wall projection extending rearward at a rear edge and a side wall recess extending inward a front edge, and a rear wall and a spaced apart front wall, each of the rear wall and the front wall coupled to the top wall, the bottom wall, the left side wall, and the right side wall;

a nose cap configured to connect to the front end of the forward element, the nose cap including a first slit horizontally oriented and positioned at a first height, and a second slit horizontally oriented and positioned at a second height, the first slit and the second slit in combination forming a weakened midsection positioned in alignment with the notch of the forward element;

a vehicle capture structure formed by the nose cap and the forward element, the vehicle capture structure configured to capture a vehicle frontally impacting the forward element, resist upward tilting of the impacting vehicle, and substantially prevent ramping of the impacting vehicle over the forward element; and a midnose structure configured to be positioned between the forward element and a first crash cushion element and to reduce the vaulting tendency of the vehicle impacting the crash cushion elements, the midnose structure including:

a front section configured to couple to the rear wall of the forward element, the front section including a couple of midnose recesses, each midnose recess configured to receive the side wall projection from either the left side wall or the right side wall of the forward element, and a rear section configured to couple to the front wall of the first crash cushion element, the rear section including a couple of midnose projections, each midnose projection configured to fit into the side wall recess of either the left side wall or the right side wall of the first crash cushion element.

19. The anchorless crash cushion apparatus of claim 18, wherein the midnose structure further includes:

a lower horizontal member configured to contact the bottom wall of the forward element and to underlie a portion thereof and an upper horizontal member configured to contact the top wall of the forward element and overlap a portion thereof.

20. An anchorless crash cushion apparatus comprising:

a plurality of crash cushion elements filled with water and configured to connect to one another;

an empty forward element positioned in front of the crash cushion elements and including a rearward extending notch located at a front end roughly midway between a top and a bottom thereof, wherein the forward element and each crash cushion element include:

a top wall and a spaced apart bottom wall, a left side wall and a spaced apart right side wall, each side wall coupled to the top wall and the bottom wall, each side wall including a side wall projection extending rearward at a rear edge and a side wall recess extending inward a front edge, and a rear wall and a spaced apart front wall, each of the rear wall and the front wall coupled to the top wall, the bottom wall, the left side wall, and the right side wall;

a nose cap configured to connect to the front end of the forward element, the nose cap including a first slit horizontally oriented and positioned at a first height, and a second slit horizontally oriented and positioned at a second height, the first slit and the second slit in combination forming a weakened midsection positioned in alignment with the notch of the forward element;

a vehicle capture structure formed by the nose cap and the forward element, the vehicle capture structure configured to capture a vehicle frontally impacting the forward element, resist upward tilting of the impacting vehicle, and substantially prevent ramping of the impacting vehicle over the forward element; and a transition weldment positioned between a last crash cushion element and a rigid structure, the transition weldment including:

a housing with side walls, a front plate configured to receive the rear wall of the last crash cushion element, and an upper bracket and a lower bracket each configured to secure the housing to the rigid structure.

21. An anchorless crash cushion apparatus comprising:

a plurality of crash cushion elements filled with water and configured to connect to one another;

an empty forward element positioned in front of the crash cushion elements, the forward element and each crash cushion element including a top wall and a spaced apart bottom wall, a left side wall and a spaced apart right side wall, each side wall coupled to the top wall and the bottom wall, each side wall including a side wall projection extending rearward at a rear edge and a side wall recess extending inward a front edge, a rear wall and a spaced apart front wall, each of the rear wall and the front wall coupled to the top wall, the bottom wall, the left side wall, and the right side wall, the front wall including a rearward extending notch located roughly midway between the top wall and the bottom wall and the rear wall including a forward extending stabilizing member located roughly midway between the top wall and the bottom wall;

a nose cap configured to connect to the front end of the forward element, the nose cap including a first slit horizontally oriented and positioned at a first height, and a second slit horizontally oriented and positioned at a second height, the first slit and the second slit in combination forming a weakened midsection positioned in alignment with the notch of the forward element;

a vehicle capture structure formed by the nose cap and the forward element, the vehicle capture structure configured to capture a vehicle frontally impacting the forward element, resist upward tilting of the impacting vehicle and substantially prevent ramping of the impacting vehicle over the forward element;

a plurality of straps, each strap configured to couple a first joint of a first pair of connected crash cushion elements to a second joint of a second pair of connected crash cushion elements; and a transition weldment positioned between a last crash cushion element and a rigid structure, the transition weldment including:

a housing with side walls, a front plate configured to receive the rear wall of the last crash cushion element, and an upper bracket and a lower bracket each configured to secure the housing to the rigid structure.

* * * * *